US006112383A

United States Patent [19]

Salam

[11] Patent Number: 6,112,383

[45] Date of Patent: Sep. 5, 2000

[54] BAG TAG AND ZIPPER LOCK AND METHOD OF MAKING

[76] Inventor: Abdul Salam, P.O. Box 6847, Laguna Niguel, Calif. 92607-6847

[21] Appl. No.: 09/146,392

[22] Filed: Sep. 1, 1998

[51] Int. Cl.[7] ..... A61G 1/00

[52] U.S. Cl. ..... 27/28; 40/637; 40/661.11; 40/662; 40/668; 24/435; 24/436; 24/703.5; 24/67 P

[58] Field of Search ..... 40/300, 586, 637, 40/661.11, 662, 668, 908; 24/435, 436, 703.5, 67 P; 27/28

[56] References Cited

U.S. PATENT DOCUMENTS

| | | | |
|---|---|---|---|
| 94,088 | 8/1869 | Doane | 24/703.5 |
| 187,027 | 2/1877 | Marston | 40/668 |
| 192,947 | 7/1877 | Smith | 40/668 |
| 535,047 | 5/1895 | Boyden | 24/703.5 |
| 1,055,280 | 3/1913 | Klann | 24/703.5 |
| 1,604,120 | 10/1926 | Hemenway | 40/662 X |
| 1,618,073 | 2/1927 | Flint | 40/661.11 |
| 1,748,740 | 2/1930 | Swinehart | 40/662 |
| 1,813,135 | 7/1931 | Baker | 40/662 |
| 2,088,689 | 8/1937 | Chernow | 40/662 |
| 2,472,743 | 6/1949 | Carlile et al. | 24/435 |
| 2,562,173 | 7/1951 | Carlile | 24/435 |
| 3,555,627 | 1/1971 | Howell | 24/415 |
| 3,805,339 | 4/1974 | Howell | 24/205.11 |
| 3,849,841 | 11/1974 | Borzner, Jr. | 24/205.11 R |
| 3,953,912 | 5/1976 | Fukuroi | 24/205 R |
| 4,136,424 | 1/1979 | Takahashi | 24/205.11 R |
| 5,222,280 | 6/1993 | Dunnebier et al. | 24/703.5 |
| 5,423,141 | 6/1995 | Myles et al. | 40/586 |

FOREIGN PATENT DOCUMENTS

| | | | |
|---|---|---|---|
| 215055 | 5/1957 | Australia | 24/435 |
| 518827 | 5/1921 | France | 24/703.5 |
| 1560615 | 3/1969 | France | 24/436 |
| 357218 | 8/1922 | Germany | 24/703.5 |
| 847433 | 8/1952 | Germany | 24/436 |
| 2036709 | 2/1972 | Germany | 24/435 |
| 6027 | of 1891 | United Kingdom | 40/637 |
| 23374 | of 1911 | United Kingdom | 40/668 |
| 1417714 | 12/1975 | United Kingdom | 24/435 |

OTHER PUBLICATIONS

The Professional Embalmer "Undertakers Supply Company" advertisement, Mar. 1955.

*Primary Examiner*—Terry Lee Melius
*Assistant Examiner*—Andrea Chop
*Attorney, Agent, or Firm*—James G. O'Neill

[57] ABSTRACT

A combination bag tag and zipper lock is formed from a stamped out piece of metal, and has a pair of pointed legs which may be formed from a frangible central portion and bent outwardly, away from a first surface of the stamped out blank so as to form a pair of pointed securing elements. The securing elements are preferably bent outwardly at about 90° from the first surface, and have their pointed ends inserted through opposite sides of a zipper closure at either or both ends on a body bag until a bottom surface of the bag tag/zipper lock contacts the closed zipper closure. The securing elements are then bent over the closed zipper closure so as to securely hold the zipper closure together.

4 Claims, 1 Drawing Sheet

BAG TAG AND ZIPPER LOCK AND METHOD OF MAKING

BACKGROUND OF THE INVENTION

1. Field of the Invention

This invention relates generally to fasteners, and more particularly to a fastener to prevent zippers in a body bag from tearing, and the method of making such a fastener.

2. Description of Related Art

Body bags are well known for use in transporting dead bodies from one location to another. Such body bags are required by law in many jurisdictions, to prevent contamination or spread of diseases by fluids and/or gasses coming from a dead body. Such body bags come in various sizes, depending on the size and/or shape of the body to be transported, and include a zipper closure on the top thereof, which is opened to place the body within the bag, and then closed to seal the body completely therein.

Because of the varying sizes and shapes of the human body, and the different distributions of weight of a body contained in a body bag during transport in a vehicle or by other means, especially when disturbed, jarred, or jolted, the body within the bag may shift. In many instances, such movements have been known to tear or rupture the bag at one or both ends of the zipper closure and body fluids may leak out or the body may actually fall out. Therefore, to meet the requirements of law, and to better safeguard the public from a body in a bag whereby no body fluids will inadvertently exit from the bag in an unwanted area, there exists a need in the art for means to insure that the zipper closure will not rupture or tear at either end during handling or opening of the zipper closure when a body is to be inserted therein. If the zipper closure tears at the time of handling, a new bag must be used, if available, or the risk of contamination is significantly increased.

It is known to reinforce the ends of regular zipper fasteners by sewing, or placing flaps thereover. While these limited improvements overcome some of the problems encountered when handling other types of bags, such known means are limited to specific applications, and are not strong enough to be applied to zipper closures in body bags. Therefore, the present invention provides an improved and reliable means or system for strengthening the ends of a zipper closure in a body bag, where they are most vulnerable to rupturing or tearing, when being opened in a hurry, or if turned inside out, or otherwise mishandled during opening for the loading of a body therein.

SUMMARY OF THE INVENTION

Accordingly, it is a general object of the present invention to provide an improved holding device for a zipper closure. It is a particular object of the present invention to provide an improved holding device to be used at the ends of a zipper closure in a body bag. It is a still more particular object of the present invention to provide an improved zipper holding device having a plurality of sharp members which are bent to secure the zipper lock in position. It is yet a more particular object of the present invention to provide an improved combination bag tag and zipper lock which is easily applied to and secured in place at either or both ends of a zipper closure in a body bag to provide added security thereto. And, it is a still further object of the present invention to provide a method for making a bag tag and zipper lock for a body bag.

In accordance with one aspect of the present invention, there is provided a zipper lock comprised of a flat planar member having a pair of pointed securing elements that may be inserted through and then bent around or over a zipper closure at the ends thereof to prevent the zipper closure from being torn or otherwise ruptured at the ends thereof. The invention also comprises a method for forming a combination body bag tag and zipper lock including the steps of forming a blank with a frangible center; opening or bending arms formed in the frangible center and securing the combination bag tag and zipper lock to an end of a zipper closure on a body bag.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figure 1:
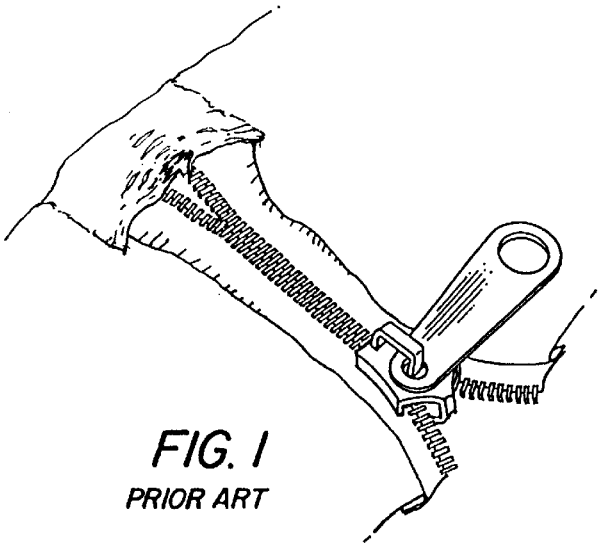
FIG. 1 PRIOR ART
FIG. 1 is a perspective view showing a prior art body bag zipper closure having no securing means at the end thereof, wherein the end of the zipper closure has been ruptured or torn apart, rendering the body bag unusable.
Figure 4:
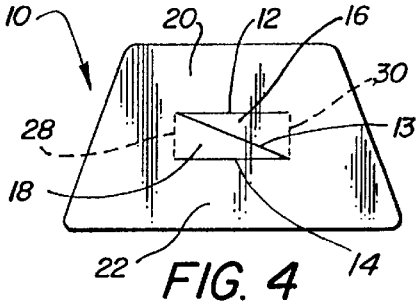
FIG. 4 is a top plan view of a blank bag tag/zipper lock having a frangible central portion before the central portion is opened for insertion over a zipper closure.
Figure 5:
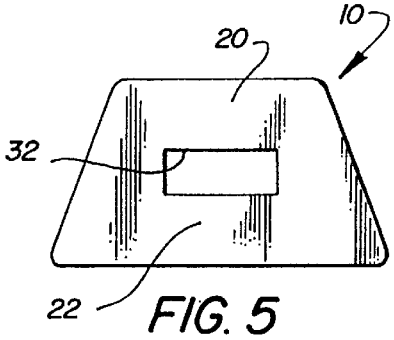
FIG. 5 is a top plan view of the bag tag/zipper lock of FIG. 4, with the frangible central portion opened or pushed downwardly so as to form an open central portion therein.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified zipper lock for use on a body bag to lock either or both ends of a zipper closure against rupture or tearing during handling or opening.

The zipper lock may be constructed in any desired manner, by any known fabrication method, but is preferably formed or stamped out of a single piece of metal, such as steel. The zipper lock may be of any desired size, and is, for example, made from a cadmium or zinc plated steel. Furthermore, the zipper lock may be made in any desired shape, such as a straight staple, a trapezoidal shaped combination bag tag and zipper lock, as shown at 10 in FIGS. 2–6, or oval, as shown at 11 in FIG. 7. The selected shape is punched or stamped out in a known manner and provided with sharpened ends. For example, as shown in FIGS. 2–6, a one piece blank 10 may be formed with a center portion thereof being formed with three cuts or lines in a "Z" shaped configuration, such as shown at 12, 13 and 14 in FIG. 4. These cuts extend entirely through the blank 10 from a first surface to a second surface. These cuts 12, 13 and 14 form two bendable or frangible pointed or sharpened spear-like holding elements, legs or prongs 16, 18, as explained more fully below. Information may be stamped and/or printed on the top and bottom areas 20, 22 of FIGS. 2, 4 and 5, and on areas 24 and 26, of the oval blank 11 of FIG. 7. Or, these blank areas 20, 22, 24 and 26 may be provided with a coating so that information may be entered with a pen or other marking device to identify and/or date the body bag and/or its contents.

Figure 2:
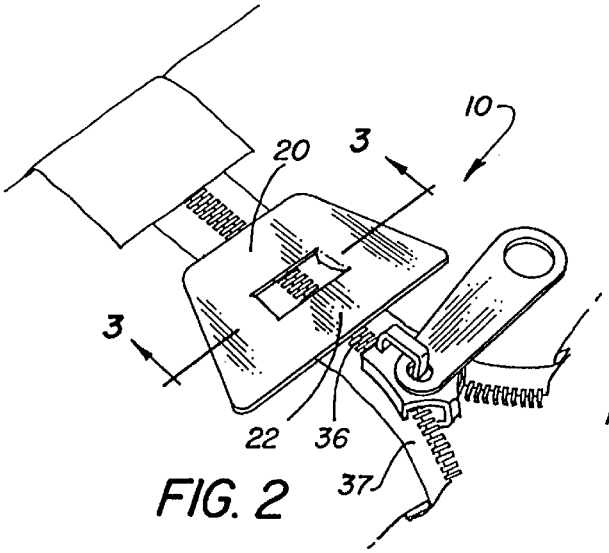
FIG. 2 is a perspective view, looking toward the top, of one end of a body bag zipper closure having a first embodiment of a bag tag and zipper lock of the present invention secured thereto in position to prevent the end of the zipper closure from being ruptured or torn.
Figure 6:
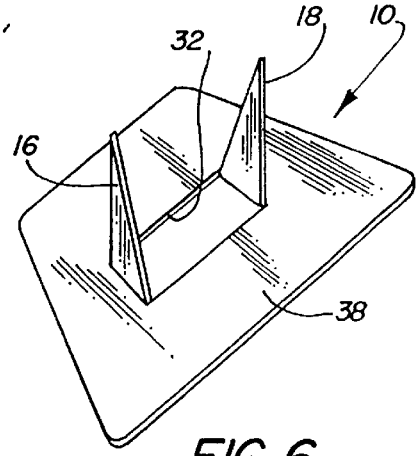
FIG. 6 is a bottom perspective view of the bag tag/zipper lock of FIG. 5 showing sharpened legs or locking portions pushed out from the frangible central section thereof in position where they may be inserted through the cloth side edges of a zipper closure before being bent inwardly to secure the bag tag/zipper lock in position around a zipper closure.
Figure 3:
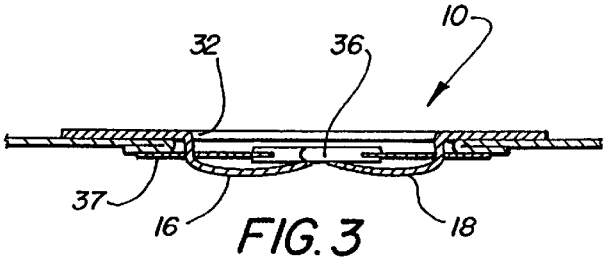
FIG. 3 is a cross sectional view through the zipper closure and bag tag/zipper lock, taken along line 3—3 of FIG. 2.
Figure 7:
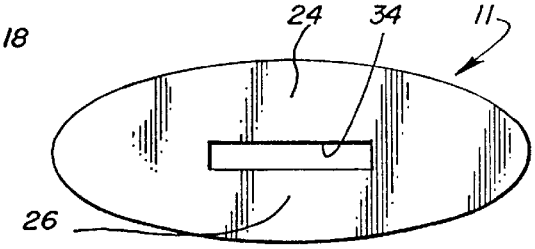
FIG. 7 is a top plan view of a second embodiment of the bag tag/zipper lock of the present invention with the frangible central portion thereof opened or pushed outwardly whereby the sharpened holding members thereof are in a position for use, such as shown in FIG. 6.

After the three cuts 12, 13, 14 have been formed through the blank 10, sharpened elements 16, 18 formed thereby, are bent or punched out, in any desired manner, to the position shown in FIG. 6. The sharpened elements 16, 18 form sharp pointed securing elements, legs or prongs which are preferably bent along broken lines 28, 30 shown in FIG. 4, until they are at about 90° to the surfaces of blank 10. When bent to the position shown in FIG. 6, an open area 32 is formed in the central area of the trapezoidal blank 10, or an open area 34 is formed in the central portion of the oval blank 11. The sharpened elements 16, 18 are bent in any desired manner, such as being punched or otherwise forced outwardly to the position shown in FIG. 6. After the sharpened legs 16, 18 are bent to this position, the bag tag/zipper lock 10 is turned around, and the sharpened legs 16, 18 are placed on the cloth side edges 37 or the plastic outer side portions of the body bag, over a zipper closure 36, such as shown in FIGS. 2 and 3. The bag tag/zipper lock 10 is then pushed downwardly so that the sharply pointed ends of the securing elements 16, 18 pass through the cloth side edges 37 or plastic bag on both sides of the zipper closure 36 until the second or bottom surface 38 of the bag tag/zipper lock contacts the zipper closure 36. The securing elements 16, 18 are then bent inwardly toward the zipper closure 36 until they contact a lower portion thereof, to securely hold the bag tag/zipper lock 10 in position by the sharpened ends of the securing elements 16, 18 contacting the zipper closure 36 (see FIG. 3) to thereby aid in firmly holding both sides of the zipper closure together, thus preventing it from being torn or otherwise pulled apart during handling or opening.

It can be seen that in use, the zipper lock of the present invention may be inserted and held at either or both ends of a zipper closure on a body bag to strengthen such ends and prevent these ends from being forced, ripped or torn apart during handling or opening of the zipper closure during opening of the body bag.

Those skilled in the art will appreciate that the above-described preferred embodiments are subject to numerous modifications and adaptations without departing from the scope and spirit of the invention. Therefore, it is to be understood that, within the scope of the appended claims, the invention may be practiced other than as specifically described herein.

What is claimed is:

1. A body bag having a zipper closure and a bag tag, comprising, in combination:

a body bag;

the body bag having a zipper closure having two ends;

a bag tag comprising a zipper lock made from a one piece shaped blank of metal having a first flat surface and a second flat surface;

a frangible central portion formed in the one piece shaped blank of metal extending between the first flat surface and the second flat surface;

the frangible central portion being comprised of a pair of sharpened, triangular-shaped leg portions which are bent outwardly, away from the first surface, toward the second surface to form a pair of pointed securing elements, the pair of sharpened triangular-shaped leg portions being inserted through cloth sides of the zipper closure at one of the two ends of the zipper closure, so as to extend over and through the cloth sides of the zipper closure, the pair of sharpened, triangular-shaped leg portions being bent and contacting the zipper closure to prevent the zipper closure from coming apart.

2. The body bag, zipper closure and bag tag of claim 1 wherein the first flat surface includes a top area and a bottom area adjacent to the frangible central portion, which top area and bottom area may have printed information applied thereto.

3. The body bag, zipper closure and bag tag of claim 1 wherein the one piece shaped blank of metal is trapezoidal in shape.

4. The body bag, zipper closure and bag tag of claim 1 wherein the one piece shaped blank of metal is oval in shape.

* * * * *